US009924818B2

(12) United States Patent
Amen Rodriguez

(10) Patent No.: US 9,924,818 B2
(45) Date of Patent: Mar. 27, 2018

(54) HANGER FOR HANGING GARMENTS

(71) Applicant: Guillermo Amen Rodriguez, Sant Joan Despí (ES)

(72) Inventor: Guillermo Amen Rodriguez, Sant Joan Despí (ES)

( * ) Notice: Subject to any disclaimer, the term of this patent is extended or adjusted under 35 U.S.C. 154(b) by 32 days.

(21) Appl. No.: 15/120,344

(22) PCT Filed: Feb. 19, 2015

(86) PCT No.: PCT/EP2015/053452
§ 371 (c)(1),
(2) Date: Aug. 19, 2016

(87) PCT Pub. No.: WO2015/124650
PCT Pub. Date: Aug. 27, 2015

(65) Prior Publication Data
US 2017/0071385 A1 Mar. 16, 2017

(30) Foreign Application Priority Data
Feb. 20, 2014 (ES) ..... 201430231 U

(51) Int. Cl.
*A47G 25/14* (2006.01)
*A47G 25/32* (2006.01)
(Continued)

(52) U.S. Cl.
CPC ..... *A47G 25/14* (2013.01); *A47B 61/003* (2013.01); *A47B 61/02* (2013.01); *A47G 25/32* (2013.01)

(58) Field of Classification Search
CPC ..... A47B 61/003; A47B 61/02
See application file for complete search history.

(56) References Cited

U.S. PATENT DOCUMENTS 3,999,656 A * 12/1976 Hydorn ..... A45C 3/00 206/279
4,487,343 A * 12/1984 Chen ..... A47G 25/32 223/85
(Continued)

FOREIGN PATENT DOCUMENTS

CN 201 577 991 U 9/2010
CN 201 710 065 U 1/2011
(Continued)

OTHER PUBLICATIONS

Written Opinion of the International Preliminary Examining Authority dated Jun. 2015.

*Primary Examiner* — Ismael Izaguirre
(74) *Attorney, Agent, or Firm* — McGlew and Tuttle, P.C.

(57) ABSTRACT

Hanger for hanging garments, provided with a support part (2, 3) intended to support a garment, and a suspension part (5) for suspending the hanger from an external structure. Suspension part (5) comprises an attachment element (4) that consists of an adherent element that constitutes a flat surface for removably attaching said suspension part (5) to the external structure. Also, said suspension part (5) comprises a first portion (7), integral to support part (2, 3), and a second portion (8), which comprises at one free end said attachment element (4), and which at the other end is joined to said first portion (7) by articulation means (10) that allow rotation of said second portion (8) with respect to said first portion (7).

12 Claims, 1 Drawing Sheet

(51) Int. Cl.
*A47B 61/02* (2006.01)
*A47B 61/00* (2006.01)

(56) References Cited

U.S. PATENT DOCUMENTS

| | | | | | |
|---|---|---|---|---|---|
| 5,137,158 | A * | 8/1992 | Brockway | B60R 7/02 | 211/106.01 |
| 2007/0246491 | A1* | 10/2007 | Shimura | A47G 25/32 | 223/85 |
| 2010/0252587 | A1* | 10/2010 | Boles | A47G 25/32 | 223/92 |
| 2015/0041504 | A1* | 2/2015 | Axlinder | A47G 25/14 | 223/85 |

FOREIGN PATENT DOCUMENTS

| | | | | |
|---|---|---|---|---|
| CN | 203 074 145 | U | | 7/2013 |
| CN | 104905651 | A | * | 9/2015 |
| CN | 104947398 | A | * | 9/2015 |
| ES | 1076038 | U | | 1/2012 |
| JP | S58 17855 | U | | 2/1983 |
| KR | 2012 0001557 | U | | 3/2012 |

* cited by examiner

HANGER FOR HANGING GARMENTS

FIELD OF THE INVENTION

This invention relates to a hanger for hanging garments, of any shape and material (metal, wood or plastic), provided at one end with a support part, intended to support garments, such as jackets, trousers, sweaters, shirts, blouses or dresses, and at a second end, with a suspension part for suspending the hanger from an external structure which is not part of the hanger, for example a structure provided in an internal space inside a wardrobe. The suspension part comprises an attachment element that consists of an adherent element constituting a flat surface for removably hanging the suspension part to the external structure.

BACKGROUND TO THE INVENTION

A large number of hangers are known provided with a hook, forming a suspension means, for hanging the hanger from a horizontal hanging bar in a wardrobe.

In another type of hangers, the suspension means are formed by a small metallic rod at the top with a widening, typically a ball, that hangs from a groove or from a sliding part on the hanging bar.

A drawback from which all current hangers suffer, irrespective of their type, is that normally they oblige arranging the hanging garments in a particular way with respect to the hanging bar inside the wardrobe or cavity or piece of furniture where they are hung, normally in a transverse direction to the bar. This also implies that the inner space cannot be maximised, due to the fact that:

- the position of the garments is obliged and forced by the actual way they are hung, and
- a cavity is left between the hanging bar and the top wall of the wardrobe, which results in a loss of useful space for the wardrobe.

Spanish Utility Model No. ES1076038U provides a magnetic hanger with a solution to this drawback, thanks to the fact that the suspension part of the hanger comprises a magnet element provided to co-operate with a metallic part of the external structure.

Based on the previous state of the art, it would be desirable to relatively improve the hanger's attachment to the external structure, and the hanger's functionality.

DESCRIPTION OF THE INVENTION

To this end, the object of the invention is a hanger of the type described at the beginning. The attachment element is an adherent element, provided to adhere in removable fashion to a complementary part of the external structure. Also, the adherent element constitutes a flat surface, which facilitates the adhesion to an external structure that can consist of a bar with a rectangular section or a flat plate provided on the top of the wardrobe space.

The hanger according to the invention is characterised because the suspension part comprises:

- a first portion, integral with the support part, and
- a second portion, comprising at one free end the attachment element, and which at the other end is joined to the first portion by articulation means that allow the rotation of said second portion with respect to said first portion.

Preferably, the articulation means are shaped so that they allow a rotation of the second portion with respect to the first portion at least around a horizontal rotation axis in the use position of said hanger.

The use position of the hanger is understood to be the hanger's rest position when it is hanging, via its suspension part, from an external structure.

In a preferred embodiment, the adherent element is a magnet, which adheres to a surface of ferromagnetic material on the support structure. In another possible embodiment, the adherent element is a support band with hooks and loops, like Velcro (registered trademark), which adheres to a complementary strip on the support structure.

According to a preferred, but not exclusive, embodiment of this invention, the articulation means between the first and second portion are made up of a linear articulation, i.e.: a hinge type articulation, that allows a rotation of the second portion with respect to the first portion around a single horizontal rotation axis in the use position of the hanger.

According to an alternative embodiment, the articulation means between the first and the second portion are made up of a swivel joint.

Thanks to this invention, the hanger can be hung in an external structure provided in a wardrobe space, in any position and orientation and without having to depend on the hanging bar typically present in wardrobes, and with the possibility that the hanging garments (jackets, trousers, sweaters, shirts, blouses or dresses) can swing slightly, due to the fact that the first portion, and therefore the support part integral with the former, can rotate with respect to the second portion that is attached to the external structure, whereby the comfort and the functionality of the hanger are improved.

Also, thanks to the articulation of the hanger according to the invention, the position of the centre of gravity of the garments is corrected naturally, compensating the weights and favouring the vertical position of the garment, without this affecting the position of the attachment element, and therefore facilitating the hanger's attachment to the external structure.

BRIEF DESCRIPTION OF THE DRAWINGS

For better understanding of the above, drawings are included which, schematically and only by way of a non-limiting example, represent a practical embodiment of the hanger of this invention. In said drawings.

DESCRIPTION OF A PREFERRED EMBODIMENT

Figure 1:
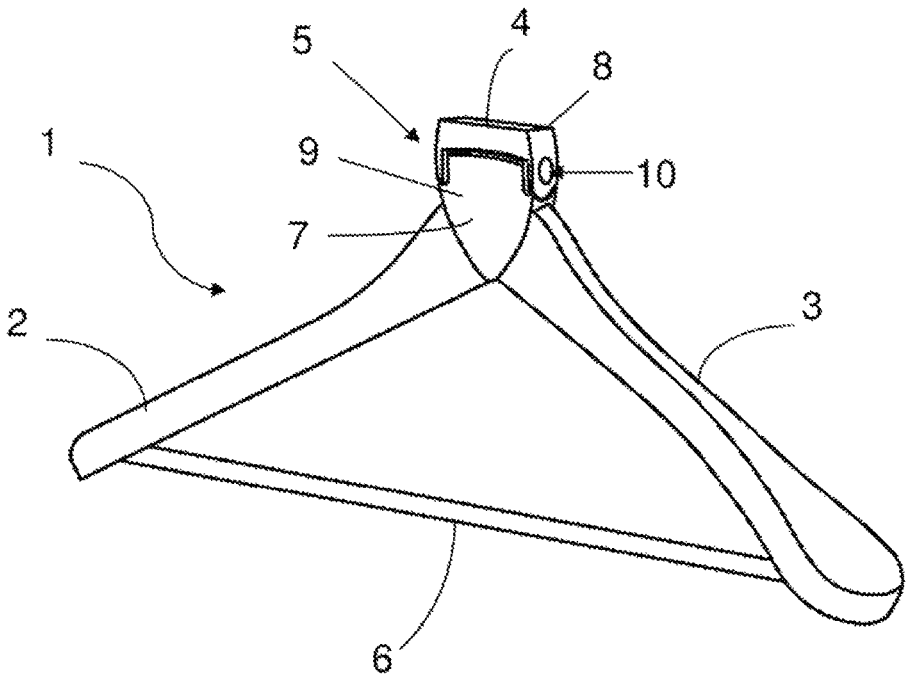
FIG. 1 is a perspective view of a magnetic hanger according to the invention, wherein all the constituent element are distinguished, and where the hanger is in a first operative position.
Figure 2:
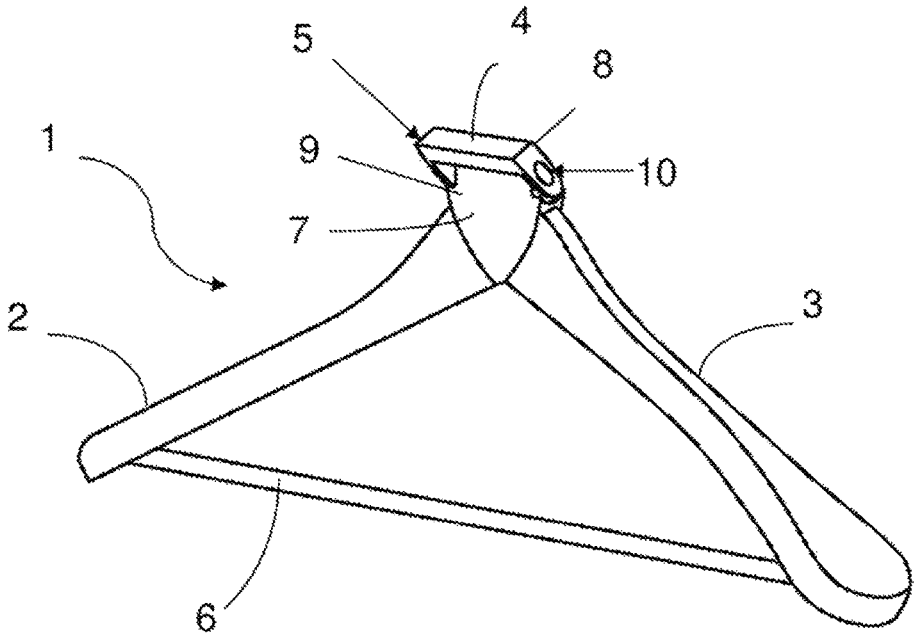
FIG. 2 is similar view to that in FIG. 1, but in a second position of the hanger, wherein the first portion has rotated with respect to the second portion.

FIGS. 1 and 2 show a hanger 1 according to this invention, which is made up of:

- at one bottom end, a support part made up of two support arms 2, 3 converging in an inverted V-shape, intended to support the weight of a garment (not shown), particularly jackets, trousers, sweaters, shirts, blouses or dresses; and
- at one top end, a suspension part 5, which has a free, flat top face provided with a magnet 4, for adhering magnetically to a part of ferromagnetic material (not shown) of an external structure.

The external structure (not shown) is, for example and particularly, a ferromagnetic metal surface orientated downwards, provided in a wardrobe space.

Magnet 4 forms an attachment element, for removably attaching suspension part 5 from the external structure. More particularly, magnet 4 forms an adherent element, for attaching through adhesion, in this case through magnetic adhesion, said suspension part 5 to said external structure.

Suspension part 5 of hanger 1 adheres magnetically to an external structure provided in a wardrobe space, so that it replaces the standard hook of the traditional hanger that hangs from the hanging bar in a wardrobe.

Hanger 1 comprises a bottom bar 6 arranged between the free ends of both support arms 2 and 3. Alternatively the hanger could have a different shape, for example a peg type shape.

Said suspension part 5 is made up of two portions:

a first portion 7, integral with support arms 2, 3 that form the support part, and a second portion 8, which is joined to the first portion by means of a joint 10, and which includes said magnet 4 at a free top end that forms a flat horizontal surface, so that second portion 8 can rotate with respect to first portion 7, and therefore with respect to the support part made up of support arms 2, 3, around a horizontal axis in the use position of the hanger, as can be seen when comparing FIG. 1 with FIG. 2.

More specifically, in the embodiment shown in the drawings, joint 10 between both portions 7, 8 of suspension part 5 is a linear joint, in other words of the hinge type, with a single horizontal rotation axis in the use position of the hanger.

Alternatively, joint 10 between both portions 7, 8 can be a swivel type joint (not shown), or any other type.

In the embodiment shown in the figures, the two support arms 2, 3 and first portion 7 are three parts that are assembled together forming an integral ensemble. Another possibility envisaged according to this invention is that first portion 7 of suspension part 5 forms a single part, without a break, together with support arms 2, 3.

The drawings show an embodiment of the hanger wherein first portion 7 has a space 9 intended for placing a brand, a decorative motif or a promotional or commercial message.

Although reference has been made to a specific embodiment of the invention, it is obvious that for a person skilled in the art that the hanger according to the invention is susceptible to numerous variations and modifications without thereby departing from the scope of the main claim. In particular, the support part can have a different shape, for example a straight, horizontal shape. Similarly, magnet 4 can be replaced by other adhesion means, such as for example bands or strips of attachment material with hooks and loops, like Velcro (registered trademark) or similar, to cooperate with a complementary material arranged on the external structure provided in a wardrobe. The articulation means, for their part, can be made up of any element that provides relative rotation between the first and second portions, preferably at least around a horizontal rotation axis in the use position of the hanger. The rotation axes can be fixed or movable. For example, some embodiments can be provided where the horizontal rotation axis undergoes a shift, due to the fact that the first and second portions can slide one with respect to the other within a vertical plane.

Also, all the details mentioned can be replaced by other technical equivalents, without departing from the scope of protection defined by the attached claims.

The invention claimed is:

1. A hanger for hanging garments, comprising:

a support part intended to support a garment; and a suspension part for hanging said hanger from an external structure that is not part of said hanger, said suspension part comprising an attachment element that consists of an adherent element that constitutes a flat surface at a free top end of said suspension part, said flat surface being provided with a magnet for removably hanging said suspension part to said external structure by magnetic adhesion of said flat surface to a ferromagnetic part of said external structure, said suspension part comprising a first portion, integral with said support part, and a second portion, said second portion comprising said attachment element at one free end of said second portion, and another end of said second portion being joined to said first portion by an articulation means for allowing rotation of said second portion with respect to said first portion.

2. A hanger according to claim 1, wherein said articulation means is adapted to allow rotation of said second portion with respect to said first portion at least around a rotation axis parallel to said flat surface.

3. A hanger according to claim 2, wherein said articulation means is a swivel joint.

4. A hanger according to claim 1, wherein said articulation means is a linear articulation, that allows rotation of said second portion with respect to said first portion around a single rotation axis parallel to said flat surface.

5. A hanger according to claim 4, wherein said linear articulation is a hinge joint parallel to said flat surface.

6. A hanger according to claim 5, wherein said support part is an inverted V-shaped part formed by two converging support arms, and said single rotation axis is parallel to said inverted V-shaped part.

7. A hanger according to claim 5, wherein said flat surface is a rectangular flat surface having a longer side, the longer side of said rectangular flat surface extending parallel to said single rotation axis.

8. A hanger according to claim 4, wherein said support part is an inverted V-shaped part formed by two converging support arms, and said single rotation axis is parallel to said inverted V-shaped part.

9. A hanger according to claim 8, wherein said flat surface is a rectangular flat surface having a longer side, the longer side of said rectangular flat surface extending parallel to said single rotation axis.

10. A hanger according to claim 4, wherein said flat surface is a rectangular flat surface having a longer side, the longer side of said rectangular flat surface extending parallel to said single rotation axis.

11. A hanger according to claim 10, wherein said second portion of said suspension part is shaped as a fork having two legs and a cross member, wherein said two legs are articulated over said single rotation axis, and said rectangular flat surface is a top face of said cross member.

12. A hanger for hanging garments, comprising:

a support part for supporting a garment; and a suspension part for hanging said hanger from an external structure, said external structure being a separate structure from said hanger, said suspension part comprising an attachment element, said attachment element comprising an adherent element, said adherent element comprising a flat surface at an upper end of said suspension part, said flat surface being connected to a magnet for removably hanging said suspension part to said external structure by magnetic adhesion of said flat surface to a ferromagnetic part of said external structure, said suspension part comprising a first portion and a second portion, said first portion being integrally connected to said support part, said second portion having one end portion and another end portion, said one end portion being connected to said attachment element, said another end portion being connected to said first portion by an articulation means for allowing said second portion to rotate with respect to said first portion.

* * * * *